US006349125B1

(12) United States Patent
Maeder

(10) Patent No.: US 6,349,125 B1
(45) Date of Patent: Feb. 19, 2002

(54) APPARATUS FOR COUNTING FLAT OBJECTS

(75) Inventor: Carl Conrad Maeder, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/582,190

(22) PCT Filed: Dec. 29, 1998

(86) PCT No.: PCT/CH98/00559

§ 371 Date: Jun. 22, 2000

§ 102(e) Date: Jun. 22, 2000

(87) PCT Pub. No.: WO99/35613

PCT Pub. Date: Jul. 15, 1999

(30) Foreign Application Priority Data

Dec. 30, 1997 (CH) ..... 2984/97

(51) Int. Cl.[7] ..... G06M 7/06
(52) U.S. Cl. ..... 377/8; 198/958
(58) Field of Search ..... 198/502.1, 958; 271/265.01, 149, 216, 258.01; 377/8

(56) References Cited

U.S. PATENT DOCUMENTS 1,544,860 A * 7/1925 Reisbach ..... 377/8
3,571,574 A * 3/1971 Uster ..... 377/8
3,684,845 A * 8/1972 Palmer ..... 200/61.41
4,713,831 A * 12/1987 Morisod ..... 377/8
4,746,004 A * 5/1988 Hess et al. ..... 377/8 X
5,022,644 A * 6/1991 Burge ..... 271/216 X
5,084,906 A 1/1992 Reist

FOREIGN PATENT DOCUMENTS

| | | |
|---|---|---|
| DE | 24 46 184 A | 4/1976 |
| EP | 0 408 490 A | 1/1991 |
| GB | 2 165 676 A | 4/1986 |

* cited by examiner

*Primary Examiner*—Joseph D. Pape
*Assistant Examiner*—Patricia Engle
(74) *Attorney, Agent, or Firm*—Alston & Bird LLP

(57) ABSTRACT

An apparatus for counting flat objects, such as printed products, which are conveyed in an overlapping formation, and which comprises a guide means extending in the conveying direction and mounting a contact element for reciprocatory movement therealong. A drive serves to move the contact element cyclically in the conveying direction at a speed greater than the conveying speed of the overlapping objects, so that it can be brought into contact with the rear edge of each object. A detector element emits a signal to a counter upon contact between the contact element and the rear edge of an object, and a reference element is provided which rests upon the overlapping formation from above to ensure that the contact element mounted on the guide means and the formation assume a precisely defined mutual position.

8 Claims, 3 Drawing Sheets

APPARATUS FOR COUNTING FLAT OBJECTS

BACKGROUND OF THE INVENTION

The present invention relates to an apparatus for counting flat objects, especially printed products.

An apparatus of this type is disclosed by EP-A-0 408 490. A conveying device, having a conveyor belt which is driven in circulation, for example, is intended to convey printed products in an overlapping stream in which, as viewed in the conveying direction F, each printed product rests on the printed product respectively preceding it. Arranged underneath the conveyed printed products is a guide means, extending in the conveying direction, for a contact element. The latter is moved to and fro by means of a drive, the speed of the contact element in the conveying direction, at least in one section of the guide means, being greater than the conveying speed, in order to bring the contact element in each case into contact with the rear edge of a printed product. A detector element interacts with the contact element and, in each case, emits a signal to a counter upon contact between the contact element and the relevant rear edge. This apparatus is designed to count, with high reliability, printed products arriving at a system cycle rate.

It is an object of the present invention to provide a generic apparatus which is suitable for counting objects arriving in an overlapping formation, in which each object rests on the respectively following object.

SUMMARY OF THE INVENTION

The above and other objects and advantages of the present invention are achieved by the provision of an apparatus which comprises a conveying device which is configured to convey the objects resting on it in an overlapping formation, and a guide means extending at least approximately in the conveying direction. A contact element is mounted for movement along the guide means, and a drive is provided to move the contact element cyclically in the conveying direction and in at least one section of the guide means at a greater speed than the conveying speed of the objects. Thus the contact element can be brought into contact with the rear edge of each object which moves past the contact element. A detector element acts to emit a signal to a counter upon contact between the contact element and the object.

The guide means is arranged above the conveying device and is fixed in relation to a reference element which is configured to rest on the overlapping formation from above. The reference element thereby ensures that the guide means and the formation assume a precisely defined mutual position, in order to ensure the reliable interaction between a contact element mounted on the guide means and the rear edge of the objects.

BRIEF DESCRIPTION OF THE DRAWINGS

The present invention will now be explained in more detail using exemplary embodiments illustrated in the drawing, in which, in purely schematic form.

BRIEF DESCRIPTION OF THE PREFERRED EMBODIMENTS

Figure 1:
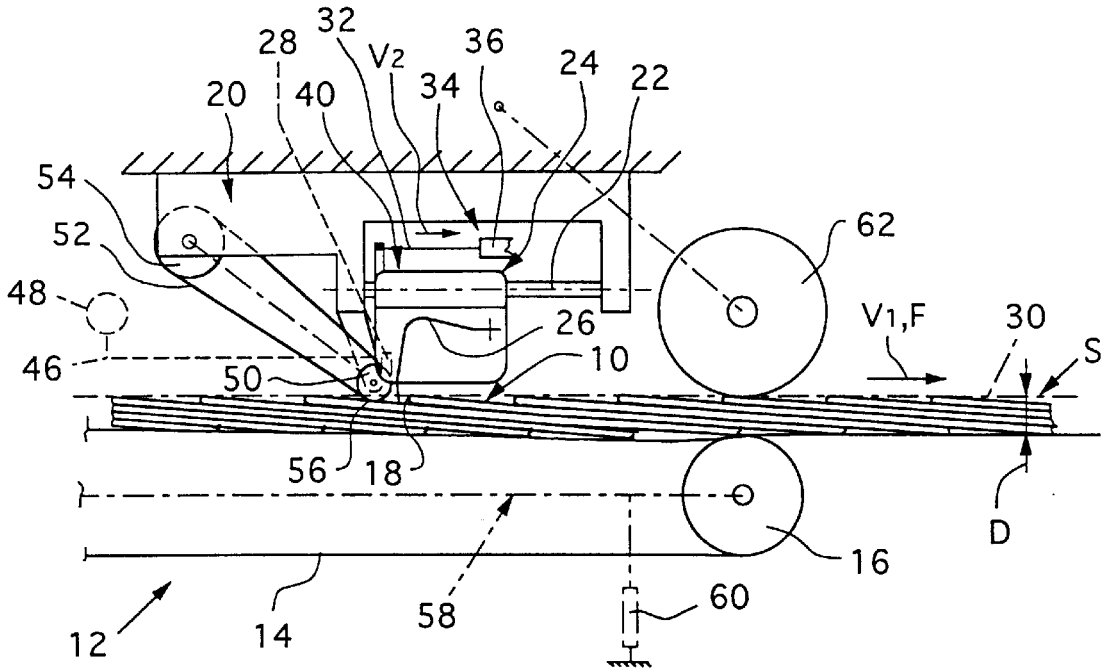
FIG. 1 shows, in elevation, a first embodiment of an apparatus according to the invention, the contact element being located in an upstream end position.
Figure 2:
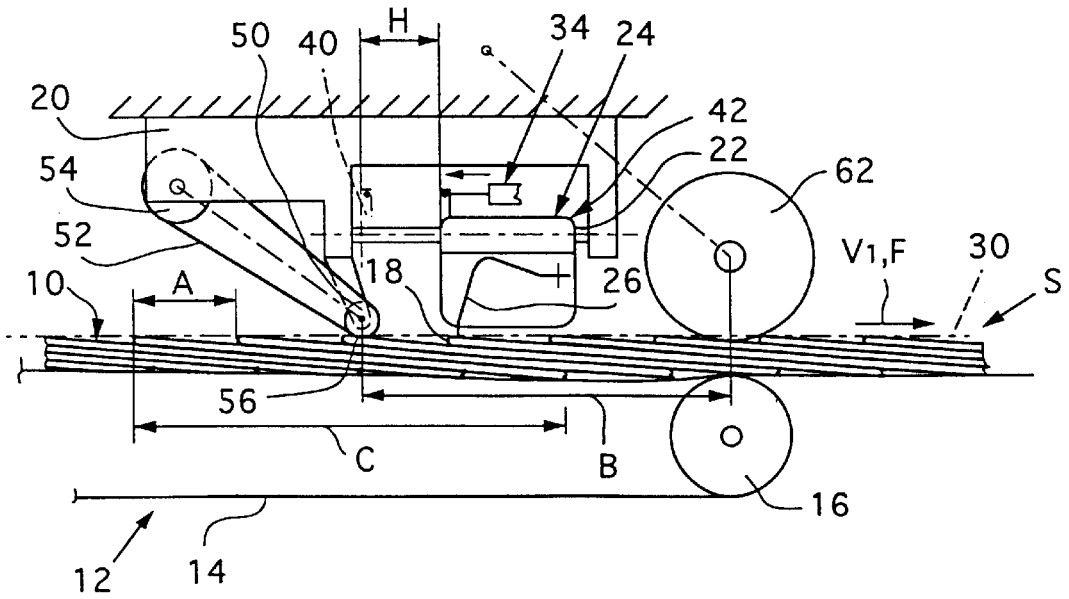
FIG. 2 shows, in the same illustration as in FIG. 1, the apparatus shown there, the contact element being located in a downstream end position.
Figure 3:
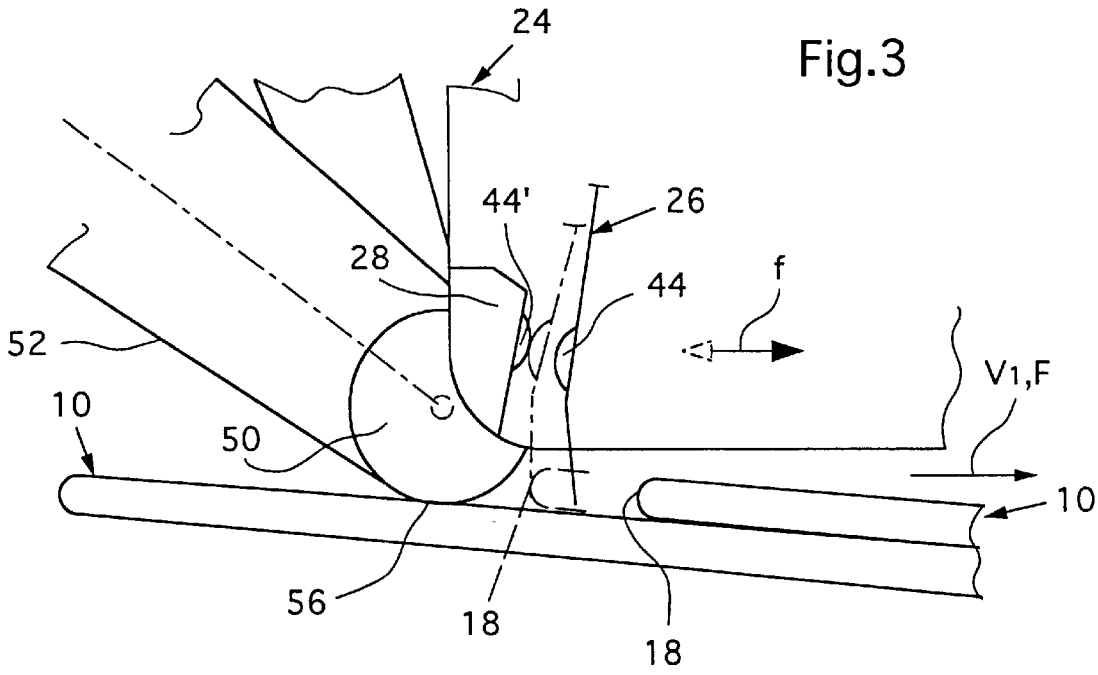
FIG. 3 shows, on a scale enlarged with respect to FIGS. 1 and 2, part of the apparatus shown there.

The apparatus shown in FIGS. 1 to 3 for counting flat objects 10, printed products in the present case, has a conveying device 12 constructed as a belt conveyor. This is intended to transport the objects 10, arranged in an overlapping formation S, at a conveying speed $v_1$ in the conveying direction F. A conveyor belt 14 of the conveying device 12, on which belt the overlapping formation S rests, is guided in a known way around turn rolls 16 which are placed at the upstream end and at the downstream end of the conveying device 12 and of which only the downstream one is shown. In the overlapping formation S, each object 10 rests on the respectively following one, the rear edge 18 of the objects 10 being exposed in the upward direction.

Above the conveying device 12, a shaft-like guide means 22 extending in the conveying direction F is arranged in a stationary position on a frame 20. Freely moveably guided on the guide means 22 is a slide 24, on which a contact element 26 and a detector element 28 are arranged. The contact element 26 projects beyond the slide 24, into the movement path 30 of the objects 10, in the direction counter to the conveying device 12.

A drive 34 for the slide 24 has a cylinder-piston unit 36 which is arranged on the frame 20 and is connected via a rod 32 to the slide 24. By means of the drive 34, the slide 24 can be moved to and fro between an upstream initial position 40, indicated in FIG. 1 by continuous lines and in FIG. 2 by dashed lines, and a downstream end position 42 illustrated in FIG. 2 by continuous lines. The stroke of the slide movement, designated by H in FIG. 2, is less than a permissible minimum distance A between the rear edge 18 of successive objects 10 in the formation S. The distance between the rear edge 18 of successive objects 10 in the formation S can vary considerably, but is never less than, but mostly greater than the permissible minimum distance A. The stroke H may also be different, by means of driving the cylinder-piston unit 36 appropriately. However, it is at most equal to, but preferably less than, the permissible minimum distance A.

$v_2$ designates the speed at which the slide 24 is moved in the conveying direction F. This speed, at least in one section of the guide means 22, is greater than the conveying speed $v_1$. The aim is advantageously for the speed $v_2$ to be at least approximately constant between short acceleration sections in the two end regions of the stroke H.

As FIGS. 1 and 2 reveal, the contact element 26, constructed like a leaf spring, is fixed at one end to the slide 24 and, adjacent to its other end, projecting beyond the slide 24, is provided with a switching contact element 44, which interacts with a switching contact element 44' arranged permanently on the slide 24 and forms the detector element 28, as FIG. 3 shows. The two switching contact elements 44, 44' are connected (via lines 46 indicated by dashed lines) to a counter 48; see FIG. 1. In the rest position of the contact element 26, the switching contact elements 44, 44' are spaced apart from each other. If, during the course of a reciprocating movement of the slide 24 in the conveying direction F, the contact element 26 comes into contact with the rear edge 18 of an object 10, said element 26 is deflected, until the switching contact elements 44, 44' close the electric circuit and, as a result, generate a signal which is fed to the counter via the lines 46. If the slide 24 overtakes the rear edge 18, the contact element 26 is forced back in the upward direction, and the electric circuit is interrupted again. This can be taken from FIG. 2. The electric circuit is also interrupted if the slide 24 catches up with a rear edge 18 toward the end of a stroke and the object 10 is then removed again from the slide 24 in the conveying direction F, since said slide 24 is braked.

The frequency f at which the drive 34 moves the slide 24 to and fro is at least twice the quotient of the conveying speed $v_2$ and the permissible minimum distance A between the rear edges 18 of successive objects 10. In this case, the movement of the contact element 26 does not have to be coordinated with a system cycle rate or phase position of the incoming objects 10. In order to increase the counting accuracy, however, the frequency is preferably three to four times this quotient. In order to avoid counting an object twice, signals which are generated during two successive strokes in the conveying direction F are counted as only one signal in the counter. Thus, with regard to each object to be counted, the slide makes a number of operating strokes in the conveying direction F. This ensures precise counting even of objects 10 which arrive with a high scatter and thus not at a system cycle rate.

A reference roll 50 is freely rotably mounted on an arm of the frame 20, and thus in a stationary position with respect to the guide means 22. Led around said reference roll is an endless belt 52, which is led around a further roll 54 which is freely rotably mounted on the frame 20 upstream of the reference roll 50, as viewed in the conveying direction F, and at a greater distance from the conveying device 12 than the reference roll 50. Together with the conveyor belt 14, the belt 52 forms an inlet narrowing in the conveying direction F for the formation S and, in the region of the reference roll 50 facing the conveyor belt 14, forms a reference element 56 which is fixed in relation to the guide means 22. As can be taken in particular from FIG. 3, this reference element 56 and the free end of the contact element 26 are at least approximately at the same level. In the initial position 40, the contact element is located in the vicinity of the reference element 56.

If the turn rolls 16 of the conveying device 12 are mounted in a stationary position, the conveyor belt 14, which can also be formed by a number of conveyor belts running in parallel, is of resilient construction. The relative position between the reference element 56 and the turn rolls 16 is chosen such that, in the absence of objects 10, the distance between the conveyor belt 14 and the reference element 56 is less than the minimum thickness D of the overlapping formation S to be processed, or that the conveyor belt 14 rests on the reference element 56.

As indicated in FIG. 1, it is also conceivable for the conveying device 12 to be constructed as a rocker 58 and to be pressed upward by means of a spring element 60, in order to ensure, even in the case of a conveyor belt 14 of non-elastic or only slightly elastic construction, that the objects 10 rest on the reference element 56 during their transport, in order to accommodate different thicknesses of the formation F.

The reference element 56 is advantageously arranged between the turn rolls 16—in the conveying direction—as shown in the drawing. The belt 52 may be driven so as to circulate freely or so as to circulate at the conveying speed $v_2$.

In FIGS. 1 and 2, 62 designates a pressing element 62, designed as a weighted roller, whose distance B from the reference element 56 is at most equal to, but preferably less than, the length C of the objects 10 measured in the conveying direction F. Together with the conveyor belt 14 led around the downstream turn roll 16, the pressing element 62 forms a gap which is adapted to the current thickness of the formation S, and thus ensures reliable, displacement-free transport of the objects 10 on the conveying device 12.

Figure 6:
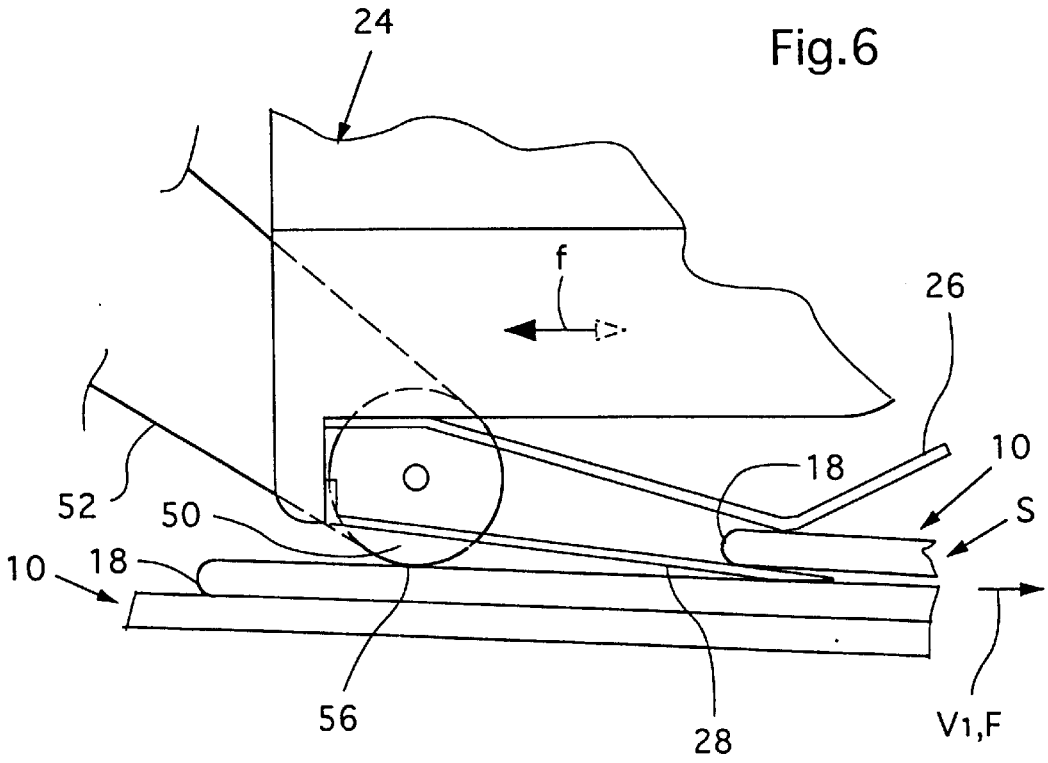
FIG. 6 shows, on a scale enlarged with respect to FIGS. 4 and 5, part of the apparatus shown there.
Figure 4:
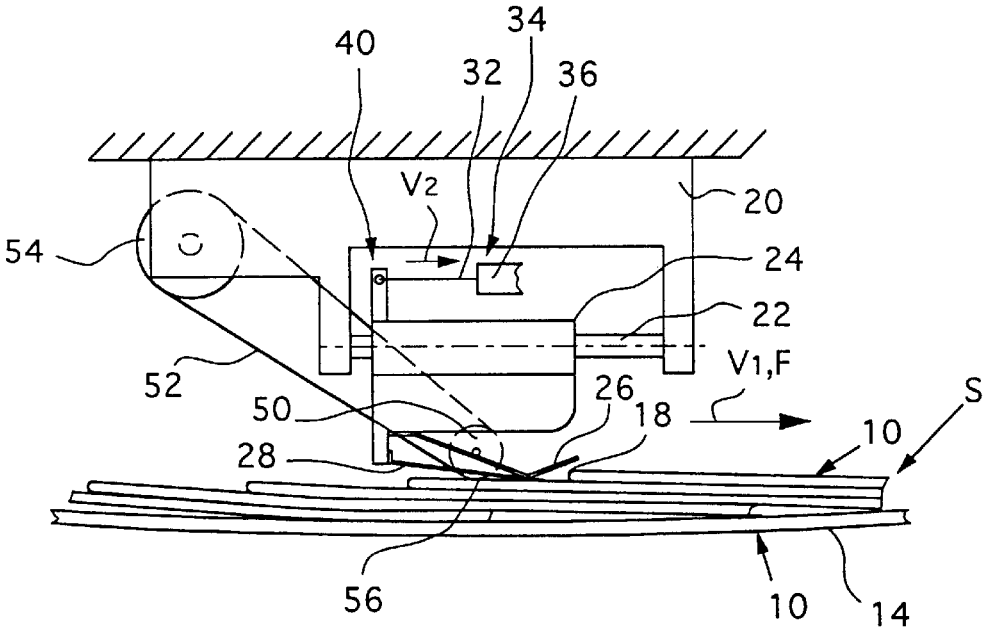
FIG. 4 shows, in elevation, a second embodiment of the apparatus according to the invention with a contact element of different design, which is located in an upstream end position.
Figure 5:
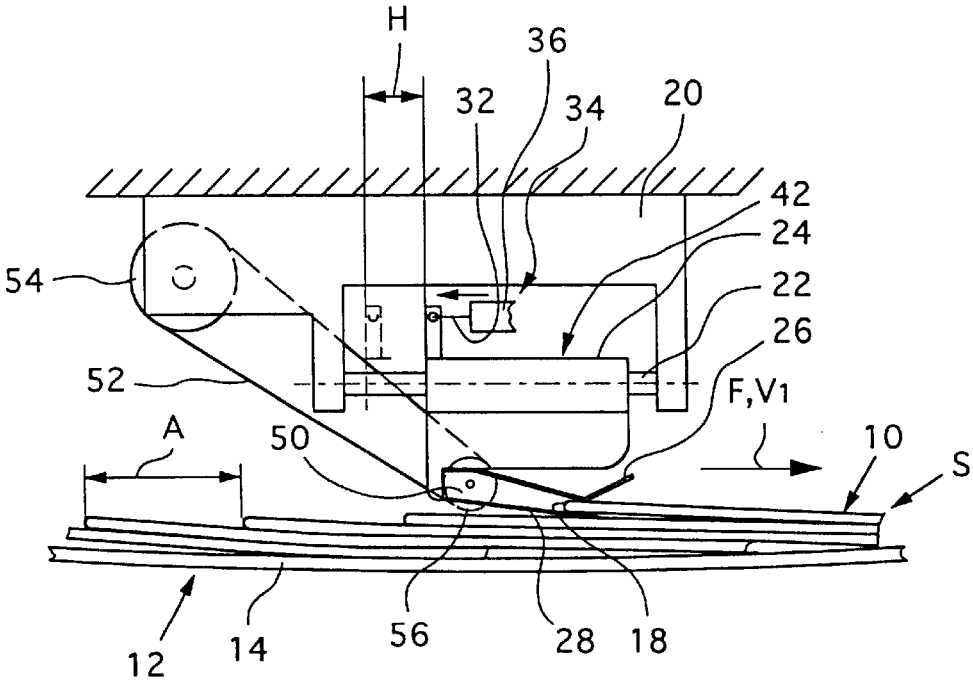
FIG. 5 shows, in the same illustration as FIG. 4, the apparatus shown there with the contact element in its downstream end position.

The embodiment shown in FIGS. 4 to 6 of the apparatus according to the invention is constructed essentially identically to the embodiment described further above and shown in FIGS. 1 to 3. Parts which act in the same way are designated by the same reference symbols, and only the differences will be described in the following text. The contact element 26 is constructed as a spring tongue, which is fixed to the slide 24 and protrudes obliquely downward from the latter in the conveying direction F. It is bent over upward in its free end region. The detector element 28 is likewise constructed as a spring tongue, fixed to the slide 24 underneath the contact element 26 and rests with its free end region on the contact element 26 at the bent-over section of the latter, FIG. 4. Here, the electric circuit connected to the counter is closed. If, then, in the course of a stroke of the slide 24 in the conveying direction F, the contact element 26 catches up with an object 10, the contact element 26, as shown in FIGS. 5 and 6, will be lifted by the relevant rear edge 18 of the object 10, while the detector element 28 runs in with its free end between this object 10 and the following object. As a result of the contact element 26 being lifted, a signal to the counter is generated, in that the electric circuit is interrupted.

In principle, it is also possible to arrange the guide means so as to be moveable in the vertical direction together with the reference element.

It is also conceivable to provide an adjusting and fixing device between the guide means and the reference element—or the reference roll—in order to be able to adjust the mutual position of the guide means and reference element, for example in order to adapt to different thicknesses of the objects.

The reference element can also be formed by a skid or a roller.

It is in principle possible to use the signal at the closing and/or at the opening of the contacts for the counting.

The optimum frequency f and the optimum stroke H for reliable counting can be defined in a straightforward way on the basis of the conveying speed $v_1$ and the permissible minimum distance A; for example this can be done by computation or with a few trials.

What is claimed is:

1. An apparatus for counting flat objects comprising a conveying device which is driven at a conveying speed in a conveying direction and is configured to convey the objects resting on it in an overlapping formation, a guide means extending at least approximately in the conveying direction and mounting a contact element for movement therealong, a drive by means of which the contact element can be moved cyclically in the conveying direction and, at least in one section of the guide means at a greater speed than the conveying speed so that it can be brought into contact with the rear edge of each object moved past the contact element, and a detector element for emitting a signal to a counter upon contact between the contact element and the rear edge of an object, wherein in order to count objects arriving in a formation in which each object rests on the respectively following object, the guide means is arranged above the conveying device and is fixed in relation to a reference element which is configured to rest on the formation from above.

2. The apparatus as claimed in claim 1, wherein the conveying device comprises a conveyor belt which is guided about a pair of turn rolls, and the reference element, as viewed in the conveying direction, is fixedly arranged between the turn rolls in such a way that the distance between the conveyor belt and the reference element, in the absence of any objects, is less than the minimum thickness of the formation of objects to be processed, or the conveyor belt rests on the reference element.

3. The apparatus as claimed in claim 2, wherein the turn rolls are mounted in a stationary position and the conveyor belt is designed so that it can be forced back elastically.

4. The apparatus as claimed in claim 2, wherein at least one of the turn rolls is mounted so as to be vertically adjustable and is loaded with a force acting upward.

5. The apparatus as claimed in claim 1, wherein the reference element comprises an endless belt which is guided around a reference roll which is rotably mounted but fixed in relation to the guide means, and around a further roll which, in relation to the conveying direction, is arranged upstream of the reference roll and at a greater distance from the conveying device than the reference roll.

6. The apparatus as claimed in claim 1, wherein the drive moves the contact element to and fro along the guide means at a frequency which is at least twice the quotient of the conveying speed and a permissible minimum distance between the rear edges of successive objects, and with a stroke which is at most as large as the permissible minimum distance between the rear edges of successive objects.

7. The apparatus as claimed in claim 1, further comprising a pressing element is arranged downstream of the reference element at a distance which is equal to or less than the length of the objects measured in the conveying direction, and so as to press the objects onto the conveying device such that they are carried along positively.

8. The apparatus as claimed in claim 7 wherein the pressing element comprises a weighted roller.

* * * * *